US009470123B2

(12) United States Patent
Lyons et al.

(10) Patent No.: US 9,470,123 B2
(45) Date of Patent: Oct. 18, 2016

(54) ENGINE STARTING CONTROL STRATEGY

(71) Applicant: International Engine Intellectual Property Company, LLC, Lisle, IL (US)

(72) Inventors: Timothy M. Lyons, Batavia, IL (US); Paul Gottemoller, Princeville, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 209 days.

(21) Appl. No.: 14/278,228

(22) Filed: May 15, 2014

(65) Prior Publication Data

US 2015/0330272 A1 Nov. 19, 2015

(51) Int. Cl.
*F01M 5/02* (2006.01)
*F02D 41/30* (2006.01)
*F02D 41/06* (2006.01)

(52) U.S. Cl.
CPC ..... *F01M 5/02* (2013.01); *F01M 5/025* (2013.01); *F02D 41/062* (2013.01); *F02D 41/30* (2013.01)

(58) Field of Classification Search
CPC .. F01M 5/025; F01M 2005/008; F01M 5/02; F01M 11/10; F02D 41/30
USPC ..... 701/102, 103, 105, 113; 123/366, 685, 123/491, 179.1, 179.3, 179.9, 196 R, 196 S, 123/198 DA
See application file for complete search history.

(56) References Cited

U.S. PATENT DOCUMENTS 1,926,801 A * 9/1933 Christian ..... F01M 5/00 123/196 S
2,102,514 A * 12/1937 Clarkson ..... F01M 5/00 123/196 S
4,077,381 A * 3/1978 Firey ..... F02D 33/006 123/179.16
4,359,140 A * 11/1982 Shreve ..... F01M 5/00 123/196 S
4,502,431 A * 3/1985 Lulich ..... F01M 5/02 123/179.1
4,875,443 A * 10/1989 Sano ..... F02D 41/061 123/179.3
4,893,598 A * 1/1990 Stasiuk ..... F01M 5/025 123/196 R
4,940,114 A * 7/1990 Albrecht ..... F01M 1/12 123/196 AB
5,121,720 A * 6/1992 Roberts ..... F01M 1/12 123/179.1
5,159,313 A * 10/1992 Kawai ..... F01M 11/10 123/196 S
5,195,476 A * 3/1993 Schwarz ..... F01M 5/02 123/179.16
5,353,753 A * 10/1994 McGrath ..... F01M 1/16 123/196 R
5,501,190 A * 3/1996 Okubo ..... F01M 1/16 123/196 M
5,542,387 A * 8/1996 Okubo ..... F01M 1/16 123/184.22
5,699,764 A * 12/1997 Allen ..... F02N 11/08 123/179.5
5,884,601 A * 3/1999 Robinson ..... F01M 5/025 123/196 A
6,248,041 B1 6/2001 Den Besten
9,031,726 B2 * 5/2015 Otterspeer ..... B60W 20/00 180/65.28
9,157,347 B2 * 10/2015 Jerwick ..... B60W 20/15
2003/0051692 A1 * 3/2003 Mizutani ..... F02D 11/105 123/179.15
2003/0079723 A1 5/2003 Mollin
2009/0020092 A1 * 1/2009 Kishibata ..... F02D 41/062 123/179.3
2009/0301435 A1 * 12/2009 Weissenborn ..... F02D 35/023 123/435
2010/0018805 A1 * 1/2010 Sachdev ..... F01M 5/025 184/6.3
2010/0320019 A1 * 12/2010 Gale ..... B60K 6/445 180/65.27
2011/0106414 A1 * 5/2011 Leanos ..... F01M 1/18 701/113
2012/0143472 A1 * 6/2012 Onishi ..... F01N 3/021 701/102

* cited by examiner

*Primary Examiner* — Erick Solis
*Assistant Examiner* — Carl Staubach
(74) *Attorney, Agent, or Firm* — Jeffrey P. Calfa; Jack D. Nimz

(57) ABSTRACT

An elapsed time from a time at which the engine last ceased running until a time of occurrence of an engine start command which causes the cranking motor and the lubrication pump to operate is measured. The onset of fueling of the engine cylinders is a function of the elapsed time measured.

15 Claims, 3 Drawing Sheets

ENGINE STARTING CONTROL STRATEGY

TECHNICAL FIELD

The disclosed subject matter relates to a control strategy for starting an engine, such as a diesel engine which propels a truck vehicle.

BACKGROUND

When an internal combustion engine is not running, engine lubricant, i.e. engine motor oil, can drain back to the sump. Excessive drainage of engine motor oil from an engine's oil pump can cause the oil pump to lose prime. Moving parts of an engine which has not been running for an extended period of time may have insufficient lubricant, and if the oil pump has lost prime, the length of time required for the pump to re-prime delays delivery of engine motor oil to moving engine parts. A result can be accelerated wear of moving parts.

SUMMARY

One general aspect of the disclosed subject matter relates to an internal combustion engine having a crankshaft, a fueling system, cylinders, pistons which reciprocate within the cylinders and rotate the crankshaft when fuel from the fueling system combusts in the cylinders, a lubrication pump operable to pump lubricant to moving parts of the engine, a cranking motor operable to rotate the crankshaft, and an engine controller which controls various aspects of engine operation including the fueling system and the cranking motor.

The engine controller comprises a control strategy for a) measuring an elapsed time from a time at which the engine last ceased running until a time of occurrence of an engine start command which causes the cranking motor and the lubrication pump to operate, and b) controlling onset of fueling of the cylinders as a function of the elapsed time measured.

Another general aspect of the disclosed subject matter relates to a vehicle having a drivetrain, including a transmission, coupling a crankshaft of a fuel-consuming engine to drive wheels for propelling the vehicle on land. The engine has a fueling system for fueling the engine, a mechanism which converts consumption of fuel into rotation of the crankshaft, a lubrication pump operable to pump lubricant to moving parts of the engine, a cranking motor operable to rotate the crankshaft, and an engine controller which controls various aspects of engine operation including the fueling system and the cranking motor.

The engine controller comprises a control strategy for a) measuring an elapsed time from a time at which the engine last ceased running until a time of occurrence of an engine start command which causes the cranking motor and the lubrication pump to operate and b) controlling onset of fueling of the engine as a function of the elapsed time measured.

Another aspect is the method which is embodied in the control strategy and which comprises a) measuring an elapsed time from a time at which the engine last ceased running until a time of occurrence of an engine start command which causes the cranking motor and the lubrication pump to operate, and b) controlling onset of fueling of the cylinders as a function of the elapsed time measured.

The foregoing summary is accompanied by further detail of the disclosure presented in the Detailed Description below with reference to the following drawings which are part of the disclosure.

DETAILED DESCRIPTION

Figure 1:
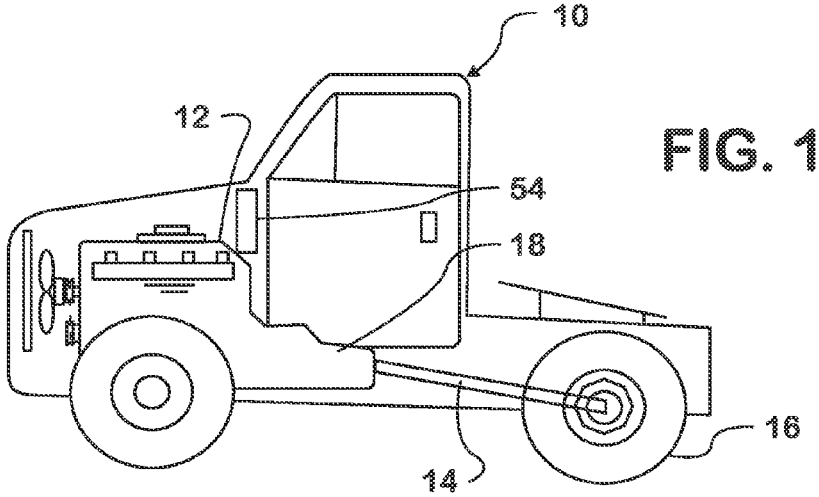
FIG. 1 is a left side view of a truck vehicle.

FIG. 1 shows a truck vehicle 10 having a fuel-consuming engine 12 which operates through a drivetrain 14 to drive wheels 16 which propel the truck vehicle on land. Drivetrain 14 includes a transmission 18 which can be shifted to various drive gears and a neutral gear.

Figure 2:
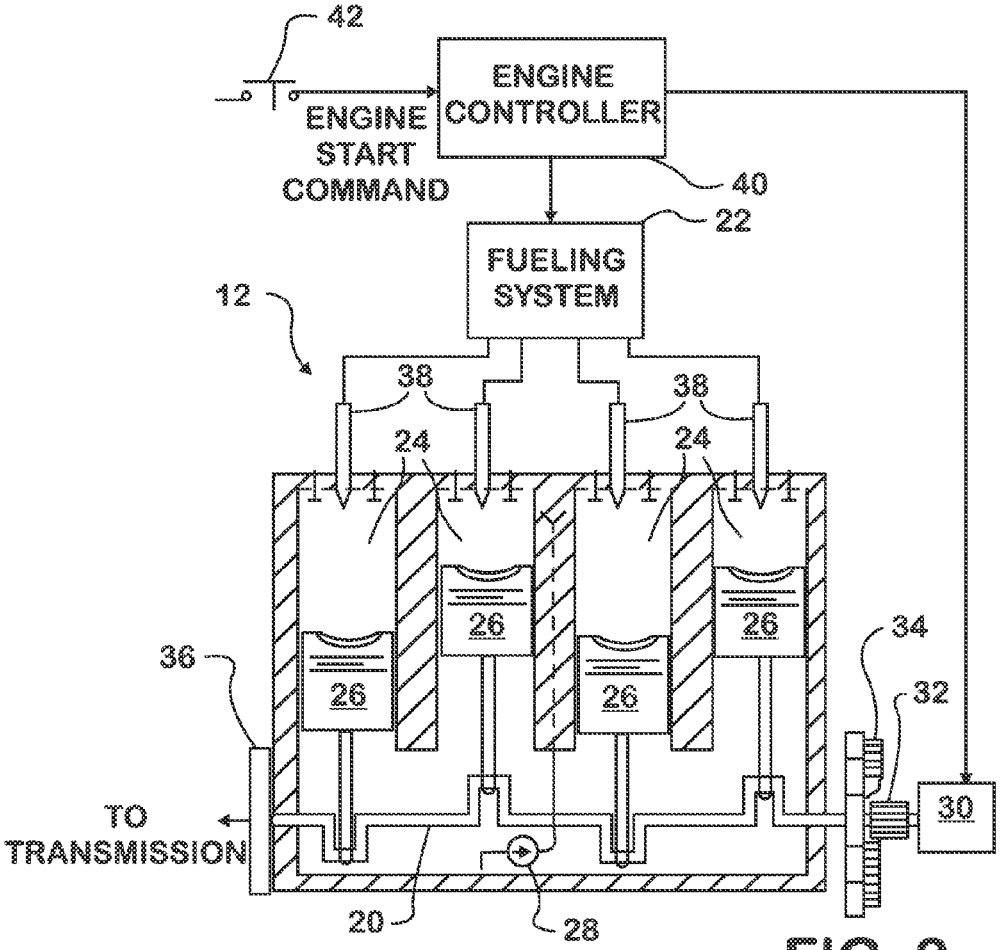
FIG. 2 is a schematic diagram of portions of an engine of the truck vehicle relevant to the present disclosure.

FIG. 2 shows engine 12 as an internal combustion (I.C.) engine having a crankshaft 20, a fueling system 22, cylinders 24, and pistons 26 which reciprocate within cylinders 24 and rotate crankshaft 20 when fuel from fueling system 22 combusts in cylinders 24.

Engine 12 also has a lubrication pump 28 (schematically depicted) which is operable to pump lubricant from a sump to moving parts of engine 12.

An electric cranking motor 30 is operable to rotate crankshaft 20 (i.e. to crank engine 12) when the engine is to be started with transmission 18 in neutral. An exemplary cranking motor has a pinion gear 32 which is mounted on the motor's shaft and can be shifted into and out of engagement with a ring gear 34 at an end of crankshaft 20. Engine cranking occurs when pinion gear 32 is engaged with ring gear 34 and cranking motor 30 is energized to rotate crankshaft 20 via pinion gear 32 and ring gear 34. Lubrication pump 28 has a pumping mechanism which is mechanically coupled through a portion of the engine's mechanism with cranking motor 30 for causing operation of cranking motor 30 to concurrently operate lubrication pump 28 with rotation of crankshaft 20 during engine starting. A flywheel 36 is mounted on an end of crankshaft 20 at which the engine's torque output is delivered to transmission 18.

When engine 12 is an I.C. engine of the diesel type, fueling system 22 comprises fuel injectors 38 for injecting diesel fuel into cylinders 24.

An engine controller 40 controls various aspects of engine operation including fueling system 22 and cranking motor 30. Engine controller 40 comprises a control strategy for a) measuring an elapsed time from a time at which engine 12 last ceased running until a time of occurrence of an engine start command which causes cranking motor 30 and lubrication pump 28 to operate, and b) controlling onset of fueling of cylinders 24 as a function of the elapsed time measured. The function comprises a delay function which delays the onset of fueling of engine 12 as a function of the elapsed time measured. The engine start command is given to engine controller 40 by a driver of truck vehicle 10 operating a start switch 42 to a START position.

Figure 3:
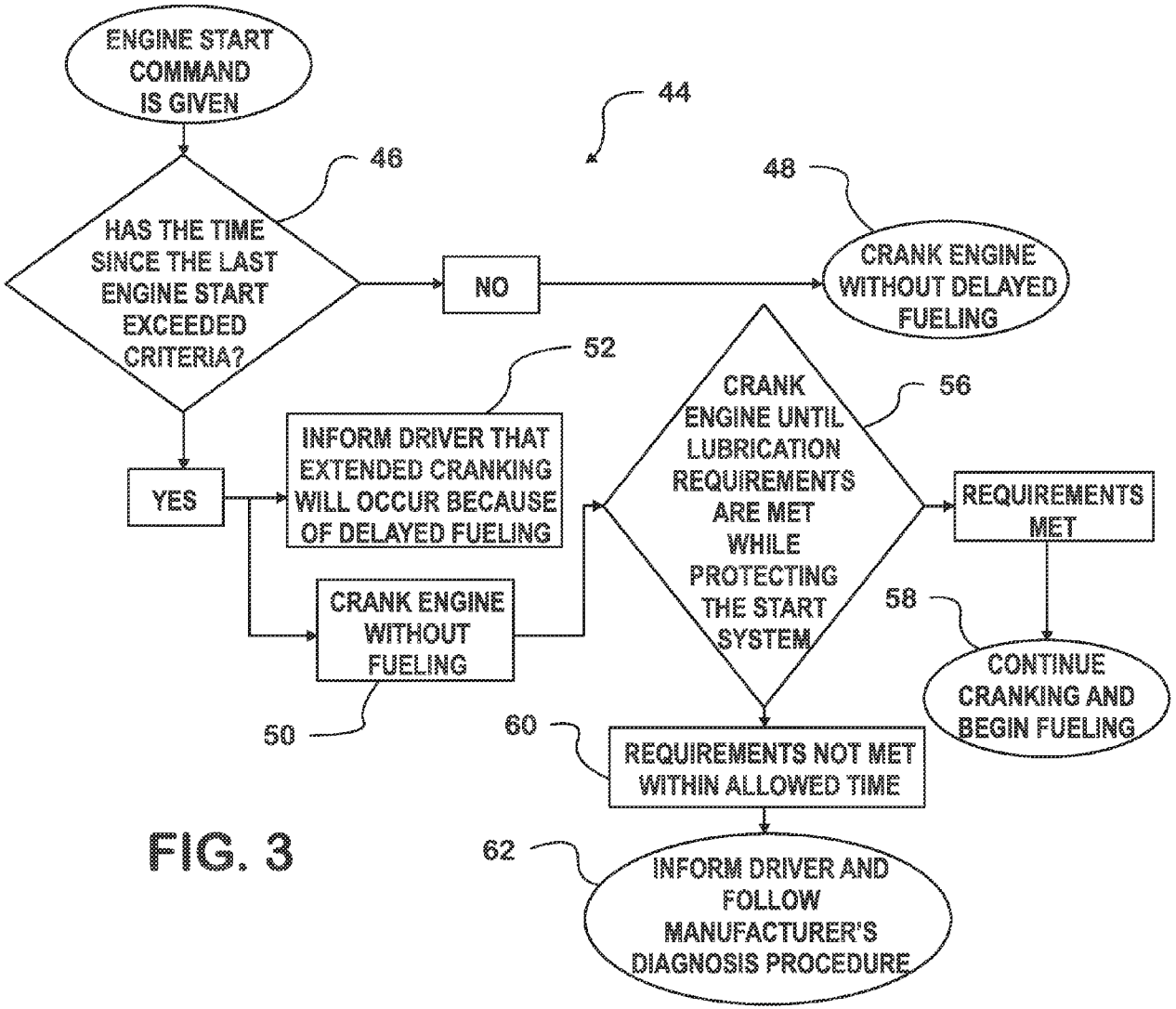
FIG. 3 is control strategy flow diagram.

FIG. 3 depicts a control strategy 44 which is embodied in a processor which executes the strategy. When the engine start command is given, a length of time from when engine 12 last ceased running is compared with certain criteria (reference numeral 46). The criteria correlate various lengths of time since engine 12 last ceased running with various values of a parameter defining various lengths of time for which engine 12 should be cranked before fueling system 22 is allowed to begin fueling the engine. If the length of time since engine 12 last ceased running is short enough that a quantity of lubricant which would likely have drained back to the sump is smaller than a quantity which would be considered excessive, engine 12 is cranked without delayed fueling (reference numeral 48). However, if the length of time since engine 12 last ceased running is longer, then engine 12 is still cranked, but with fueling being delayed in order for lubrication pump 28 to deliver lubricant in sufficient quantity to counteract the excessive drainage, thereby assuring that moving parts will be sufficiently lubricated when the engine starts.

In general, the longer the length of time since engine 12 last ceased running, the longer that fueling is delayed (reference numeral 50), but only up to a point. When engine 12 is being cranked with fueling being delayed, the driver is notified accordingly (reference numeral 52). Notification can be made via a driver information system visually and/or audibly. FIG. 1 shows a display 54 on which the driver may observe notification.

Each of various possible delay times is based on an expectation that a sufficient quantity of lubricant will have been pumped by the end of the delay time to satisfy engine lubrication specifications based on the length of time which has elapsed since the engine last ceased running (reference numeral 56). When cranking motor 30 has operated for a length of time corresponding to a selected delay time, it is presumed that sufficient lubricant has been pumped. Consequently, fueling of engine 12 begins as cranking motor 30 continues to operate (reference numeral 58). Once engine 12 has started, operation of cranking motor 30 ceases, with lubrication pump 28 becoming operated by engine 12.

An upper limit on the delay time is imposed by a maximum length of time for which cranking motor 30 is allowed to operate in order to protect the engine starting system, which includes the cranking motor and a battery system which provides energy for operating the cranking motor. When cranking motor 30 has operated for a length of time exceeding a selected delay time (reference numeral 60), it is presumed that insufficient lubricant has been pumped and consequently cranking motor 30 is stopped without any fueling of engine 12 having occurred. The driver may be informed of this via the driver information system (reference numeral 62).

Figure 4:
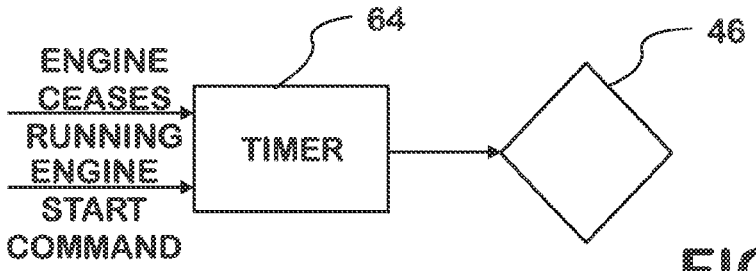
FIG. 4 is a schematic diagram of a first embodiment for calculating elapsed time used in the control strategy.

FIG. 4 shows a first example of how processing calculates elapsed time from a time at which engine 12 last ceased running until a time of occurrence of an engine start command. When engine 12 ceases running, a timer 64 starts and continues to time until an engine start command is given, at which time timer 64 stops timing. The time on timer 64 is a measurement of the elapsed time.

Figure 5:
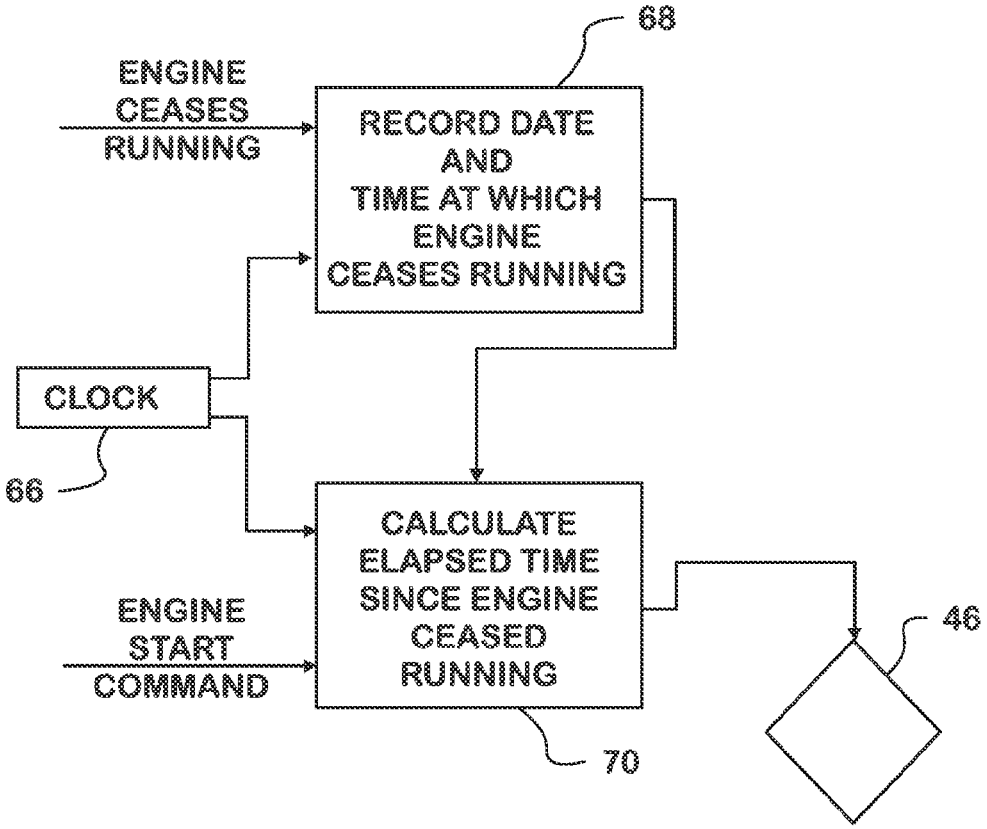
FIG. 5 is a schematic diagram of a second embodiment for calculating elapsed time used in the control strategy.

FIG. 5 shows a second example of how a clock 66 is used in processing which calculates elapsed time from a time at which engine 12 last ceased running until a time of occurrence of an engine start command. When engine 12 ceases running, a recorder 68 records the date and time on clock 66. When an engine start command is given, a calculator 70 subtracts the date and time recorded by recorder 68 from the current date and time on clock 66. The difference is a measurement of the elapsed time.

Commercial motor vehicles presently manufactured typically contain data recorders as elements of their electronic systems. A data recorder can log various events associated with operation of the vehicle and its various systems. Typically the date and time of a particular event of interest are automatically recorded. That date and time information is typically present on a data bus and is readily available to the embodiment shown in FIG. 5.

The delayed start function can be incorporated in a new vehicle and can be an upgrade to a vehicle already in service by appropriate programming into its engine control system.

What is claimed is:

1. An internal combustion engine having a crankshaft, a fueling system, cylinders, pistons which reciprocate within the cylinders and rotate the crankshaft when fuel from the fueling system combusts in the cylinders, a lubrication pump operable to pump lubricant to moving parts of the engine, a cranking motor operable to rotate the crankshaft, and an engine controller which controls various aspects of engine operation including the fueling system and the cranking motor and which comprises a control strategy for a) measuring an elapsed time from a time at which the engine last ceased running until a time of occurrence of an engine start command which causes the lubrication pump to operate while the cranking motor is operated for various lengths of time as a function of the elapsed time measured, and b) controlling onset of fueling of the cylinders as a function of the elapsed time measured.

2. An internal combustion engine as set forth in claim 1 in which the function of the elapsed time measured is a delay function which delays the onset of fueling of the cylinders as a function of the elapsed time measured.

3. An internal combustion engine as set forth in claim 2 in which the engine controller comprises a timer which begins measuring the elapsed time at a time at which the engine ceases running.

4. An internal combustion engine as set forth in claim 3 in which the elapsed time measured by the timer which controls onset of fueling of the cylinders is elapsed time on the timer at time of occurrence of the engine start command to the engine controller.

5. An internal combustion engine as set forth in claim 4 including a start switch which, when operated to a START position, causes occurrence of the engine start command to the engine controller.

6. An internal combustion engine as set forth in claim 2 in which the engine controller comprises a clock, a recorder which records a time on the clock at which the engine ceases running, and processing which, upon occurrence of the engine start command, calculates measured elapsed time by subtracting time recorded on the recorder from current time on the clock.

7. An internal combustion engine as set forth in claim 2 in which the engine comprises a mechanism through which the lubrication pump is operatively coupled with the cranking motor for causing the lubrication pump to be operated by the cranking motor.

8. A vehicle having a drivetrain, including a transmission, coupling a crankshaft of a fuel consuming engine to drive wheels for propelling the vehicle on land, the engine having a fueling system for fueling the engine, a mechanism which converts consumption of fuel into rotation of the crankshaft, a lubrication pump operable to pump lubricant to moving parts of the engine, a cranking motor operable to rotate the crankshaft, an engine controller which controls various aspects of engine operation including the fueling system and the cranking motor and which comprises a control strategy for a) measuring an elapsed time from a time at which the engine last ceased running until a time of occurrence of an engine start command which causes the lubrication the lubrication pump to operate while the cranking motor is operated for various lengths of time as a function of the elapsed time measured and b) controlling onset of fueling of the engine as a function of the elapsed time measured.

9. A vehicle as set forth in claim 8 in which the function of the elapsed time measured is a delay function which delays the onset of fueling of the engine as a function of the elapsed time measured.

10. A vehicle as set forth in claim 9 in which the engine controller comprises a timer which begins measuring the elapsed time at a time at which the engine ceases running.

11. A vehicle as set forth in claim 10 in which elapsed time measured by the timer which controls onset of fueling of the engine is elapsed time on the timer at time of occurrence of the engine start command to the engine controller.

12. A vehicle as set forth in claim 11 including a start switch which, when operated to a START position, causes occurrence of the engine start command to the engine controller.

13. A vehicle as set forth in claim 9 in which the engine controller comprises a clock, a recorder which records a time on the clock at which the engine ceases running, and processing which, upon occurrence of the engine start command, calculates measured elapsed time by subtracting time recorded on the recorder from current time on the clock.

14. A vehicle as set forth in claim 9 in which the engine comprises a mechanism through which the lubrication pump is operatively coupled with the cranking motor for causing the lubrication pump to be operated by the cranking motor.

15. A vehicle as set forth in claim 9 in which the vehicle comprises a driver information system which in consequence of the elapsed time measured imposing a delay on the onset of fueling, informs a driver of the vehicle that starting of the engine is being delayed.

* * * * *